US006205588B1

(12) United States Patent
Shin

(10) Patent No.: US 6,205,588 B1
(45) Date of Patent: Mar. 27, 2001

(54) GOLFING GLOVE WITH IMPROVED TEE HOLDER

(76) Inventor: Ku Hyon Shin, 1400 Fairlance Dr., Diamond Bar, CA (US) 91789

( * ) Notice: Subject to any disclaimer, the term of this patent is extended or adjusted under 35 U.S.C. 154(b) by 0 days.

(21) Appl. No.: 09/556,635

(22) Filed: Apr. 24, 2000

(51) Int. Cl.[7] ..... A41D 19/00

(52) U.S. Cl. ..... 2/161.4; 2/160; 2/917; 224/918

(58) Field of Search ..... 2/159, 161.1, 160, 2/161.2, 161.3, 161.4, 162, 917; 224/918; 473/205

(56) References Cited

U.S. PATENT DOCUMENTS 3,753,519 * 8/1973 Gammon ..... 224/5
4,069,954 * 1/1978 Rauch ..... 224/5
4,489,444 * 12/1984 Graham ..... 2/160
4,639,947 * 2/1987 Lanscioni ..... 2/161
5,433,436 * 7/1995 Hoyt et al. ..... 273/32
5,795,248 * 8/1998 Giglio ..... 473/406

* cited by examiner

*Primary Examiner*—John J. Calvert
*Assistant Examiner*—Katherine Moran
(74) *Attorney, Agent, or Firm*—J. E. McTaggart

(57) ABSTRACT

An improved golf glove tee holder holds tees in an orientation that is lateral relative to the major axis of the glove, i.e. through the finger tips and the cuff. This lateral orientation, along with strategic location on the back of the golf glove between the closure flap and the finger region, ensures that the golfer's wrist and knuckle joints may be fully flexed in all directions with no possibility of potential distraction, discomfort or risk of injury from the tees such as can occur with longitudinal tee orientation of conventional golf glove tee holders. The lateral orientation of the present improved tee holder is also more ergonomic: selecting and pulling out the tee is more natural and comfortable than with conventional longitudinal tee orientation. As an optional feature, a ball marker may be provided, removably attached to the closure flap of the golf glove with a snap type fastener.

6 Claims, 2 Drawing Sheets

GOLFING GLOVE WITH IMPROVED TEE HOLDER

FIELD OF THE INVENTION

The present invention relates to the field of sporting equipment, and more particularly it relates to an improved tee holder provided on a golfing glove.

BACKGROUND OF THE INVENTION

In the game of golf, it is customary to "tee off" the first stroke of each "hole" as provided in the rules, therefore golf players usually carry a supply of tees, typically in a compartment of the golf club bag. However, for convenience most players keep two or three tees in a handy location such is in a pocket or even under shoelaces. There is a similar need for ready availability of the ball marker, a small disc that is often used to mark the ball location on the putting green.

Since golfing gloves are commonly utilized, it has been known to provide tee holders on a glove; however, implementations of known art have been found to be less than ideally convenient and to have the potential of inflicting discomfort or even injury on the golfer.

DISCUSSION OF KNOWN ART

U.S. Pat. No. 5,365,609 to Herzog and Japanese patents 53-50069 and 55-12939 all disclose a golf glove with a tee holder shown as located on the back side of the left-hand glove, with the assumption that the golfer is right-handed: this assumption will be followed in the present discussion.

Patent '609 and '939 show tees held inside the flap of an overlapping closure of a type that is in common use, utilizing hook and pile fastening to secure the glove firmly to the hand.

Patents '069 shows the tee holder mounted centrally on the back of a glove having no flap but utilizing only an elastic closure of a type once popular but no longer found in common usage.

All three of the cited patents show and teach a tee holder made and arranged to hold tees in side-by-side relationship oriented in a substantially longitudinal direction relative to the forearm and fingers, '069 and '939 show the tees pointing toward the fingers while '609 shows two pointing downwardly toward the finders and one pointing upwardly, and includes a pouch for holding a ball marker.

In known art as represented by the patents cited above that are each shown holding three tees in the region of the back of the left hand, the longitudinal orientation of the tees relative to the left forearm make it inconvenient to select a tee with the right hand since the tee must be pulled out from the holder in a direction that is substantially perpendicular to the right forearm. Furthermore flexing, arching or cocking of the wrist joint tends to force the head and/or pointed end of the tee against the back region of the hand and the forearm, potentially causing distraction, discomfort or even injury, e.g. in the event of unexpected physical strain such as the golfer tripping and/or falling to the ground.

OBJECTS OF THE INVENTION

It is a primary object of the present invention to provide an improved golf glove tee holder that eliminates the potential distraction, discomfort and risk of injury that are inherent in known glove tee holders that hold the tees oriented longitudinally, i.e. parallel to an axis that traverses the finger tips and the cuff of the glove.

It is a further object to provide a golf glove tee holder that is improved over known art with regard to a golfer's convenience and ease in selecting and withdrawing a tee from the older.

It is a further object to provide an embodiment which includes improved provision for holding a ball marker.

SUMMARY OF THE INVENTION

The abovementioned objects have been accomplished by the present invention of an improved golf glove tee holder that is made and arranged to hold tees in an orientation that is lateral relative to the major axis through the finger tips and the cuff of the glove, and is thus substantially in line with the golfer's opposite forearm when a tee is grasped and pulled out with the opposite hand, whereby the acts of selecting, grasping and pulling out the tee are much more ergonomic: more natural and comfortable than with prior art.

Furthermore the transverse orientation allows full flexing of the wrist and knuckle joints in all directions with no potential distraction, discomfort or risk of injury from the tees.

As an optional feature, a ball marker may be provided, removably attached to the closure flap of the golf glove with a snap type fastener.

BRIEF DESCRIPTION OF THE DRAWINGS

The above and further objects, features and advantages of the present invention will be more fully understood from the following description taken with the accompanying drawings in which.

DETAILED DESCRIPTION

Figure 1:
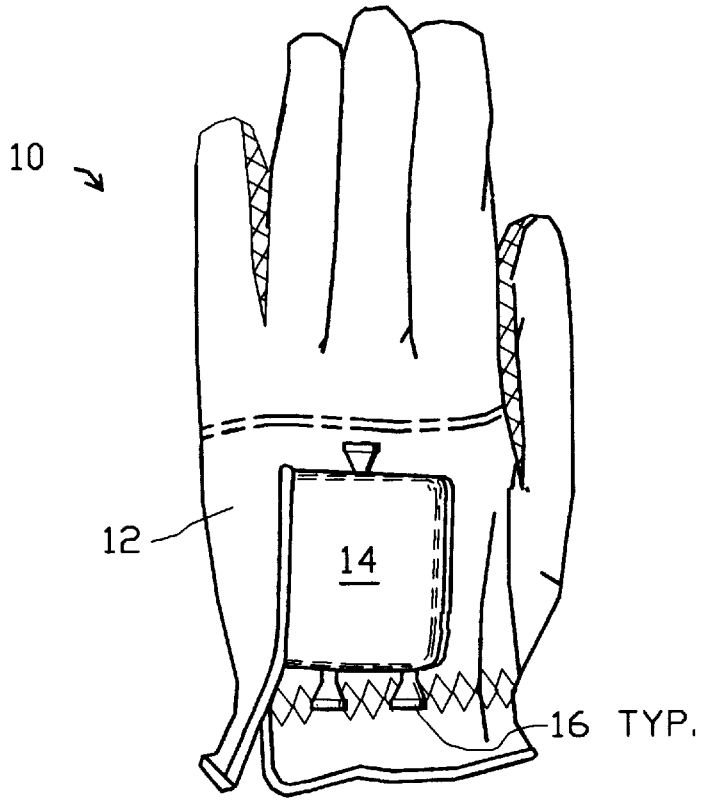
FIG. 1 PRIOR ART
FIG. 1 is a view showing the rear side of a golf glove tee holder of known art.

In FIG. 1 a rear view of golf glove tee holder 10 is shown as representing known art wherein a golfing glove 12 of fine leather or other soft material is fitted with a Velcro-fastened rear closure flap 14 that is configured internally to act as a tee trap arranged to hold 3 tees 16 oriented longitudinally relative to the glove 12. Tees 16 can be inserted and retained from either of two opposite sides as shown with two tees heads-down and one tee head-up.

Figure 2:
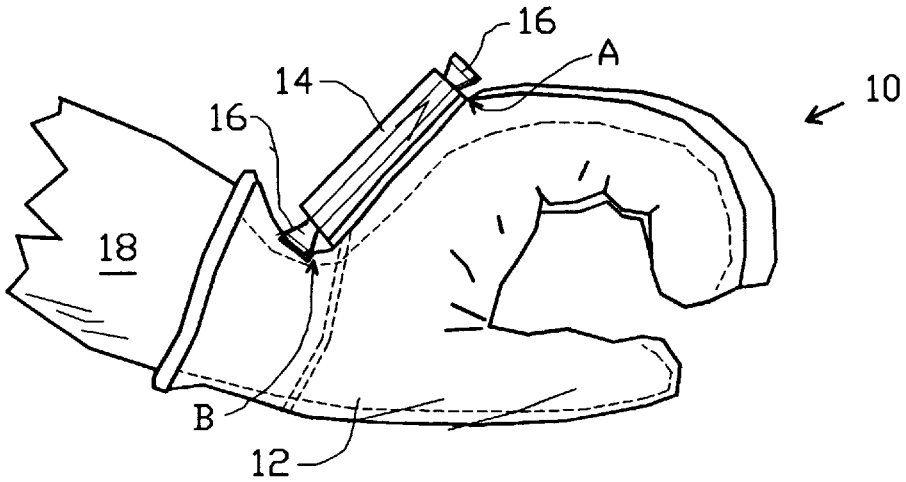
FIG. 2 PRIOR ART
FIG. 2 is a side view of a left hand in a glove of known art with a tee holder as in FIG. 1, showing the location of the tees and potential problem points of pressure from the tees when the hand is bent back.

FIG. 2 is a side view showing golf glove tee holder 10 of FIG. 1 worn on the left hand of a golfer whose partial forearm region 18 is shown with the hand in a bent back position. Tees 16 at each of holder 14 are seen to bear against the golfers hand at the knuckle and the wrist joint region as indicated by the arrow A and B indicating points of concentrated pressure from the heads of tees, that act through the soft material of the glove 12 to cause the golfer at least distraction and discomfort and potentially pain and injury.

In other configurations of known art with the tees 16 oriented longitudinally, the sharp tee points can be particularly troublesome and hazardous.

Figure 3:
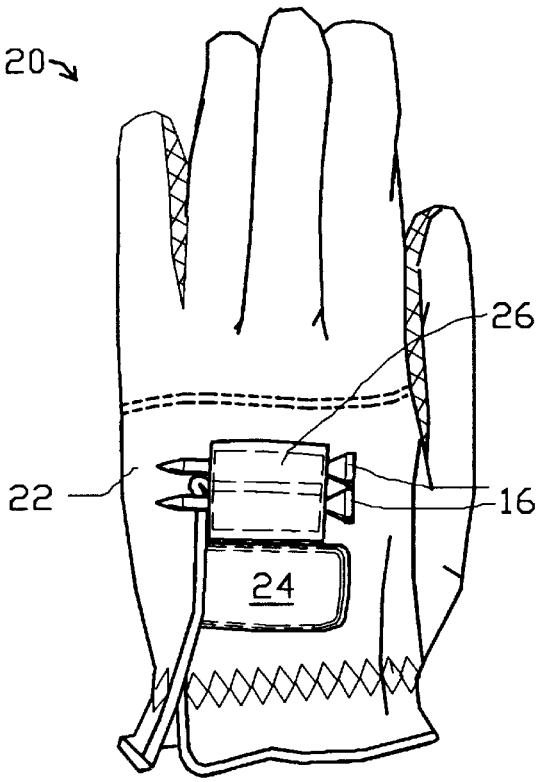
FIG. 3 depicts the rear side of a golf glove with a tee holder as configured in a basic embodiment of the present invention.

FIG. 3 is the rear view of a golf glove tee holder 20 representing the basic preferred embodiment of the present invention. Golfing glove 20, like glove 12 in FIG. 1, is made from soft material. A Velcro-fastened closure flap 24 is made narrower than normal, so as to provide sufficient space between the flap 24 and the glove fingers for the tee holder 26 shown holding two tees 16. In a departure from known art, the tee holder of the present invention is oriented to hold the tees 16 in a lateral direction relative to the major axis of glove 22: this novel orientation prevents any chance of distraction, discomfort, pain or potential injury regardless of the position of the fingers, hand, wrist and/or arm at any extreme of bending.

This novel orientation of the tees 16 is ergonomic in presenting the tee 16 as shown on the back of the left hand glove 22 so that it is easy and natural to reach with the golfer's right hand to grasp and pull the tee 16 out of the holder 26 in a direction that is substantially in line with the right arm.

Tee holder 26 may be fabricated from elastic fabric material sewn in place as shown.

Figure 4:
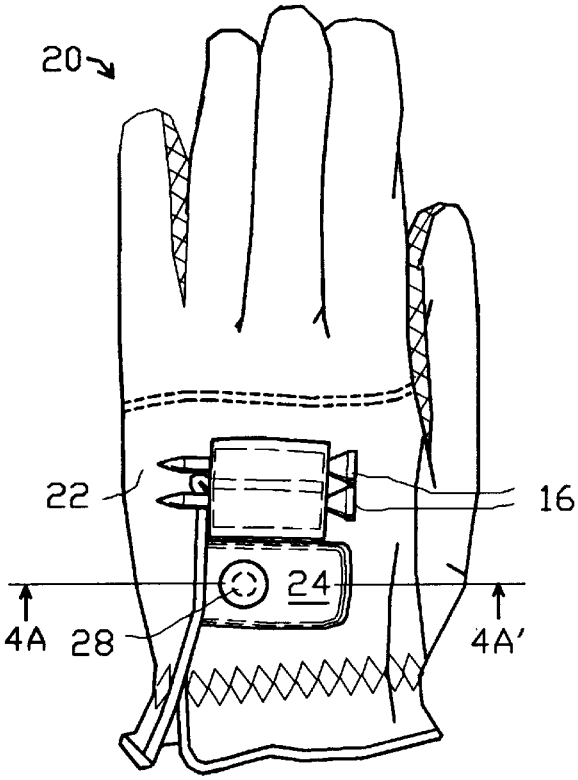
FIG. 4 depicts the rear side of a golf glove of the present invention in an embodiment similar to that of FIG. 3 but including a ball marker.

FIG. 4 is a view showing the rear side of a golf glove of the present invention, in an embodiment similar to that of FIG. 3 but which further includes provision for holding a circular ball marker 28 which may be attached by an easily detached dome type snap fastener of which the dome portion, shown in dashed lines, is affixed to the marker and the socket portion is affixed to the flap 24 of glove 22.

Figure 4A:
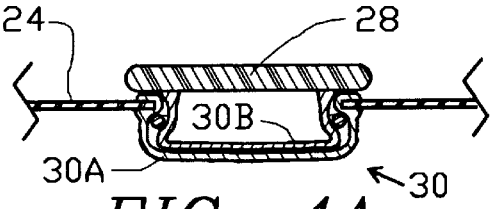
FIG. 4A is a cross-section taken through 4A–4A' of FIG. 4 showing the mated dome type fastener.

FIG. 4A is a slightly enlarged cross-section, taken through 4A–4A' of FIG. 4, showing the ball marker 28 attached to the golf glove flap 24 by two mated portions 30A and 30B of the dome-type snap fastener 30.

Figure 5:
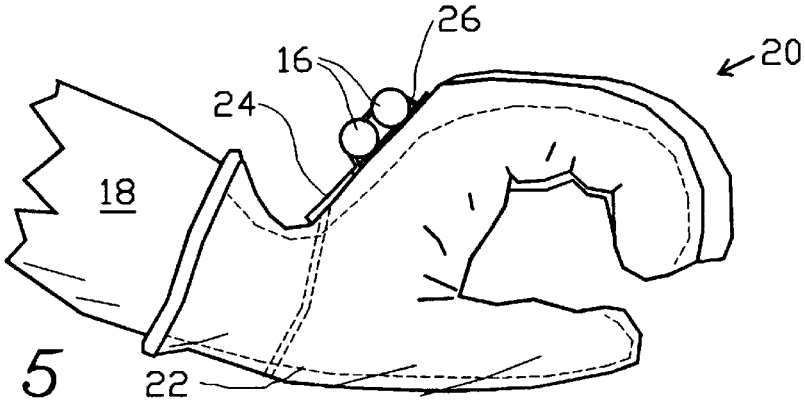
FIG. 5 is side view of a golfer's left hand, in a bent-back position, in a glove of the present invention, showing the unobtrusive location of the tees.

FIG. 5, as in FIG. 3, shows a portion of a golfer's forearm 18 in a bent back disposition; however now, with the golf glove tee holder 20 of the present invention, the two tees 16 seen in head end view, due to their lateral orientation and strategic location on the glove flap, are positioned so as to be completely unobtrusive: it is impossible for them to exert any localized pressure anywhere on the golfer's forearm region.

Thus the golf glove tee holder of the present invention provides convenient tee storage with no chance of the potential distraction, pain or injury that can occur with golf glove tee holders of prior art that retain tees oriented longitudinally relative to the glove.

The tee holder 26 of the present invention could be practiced in other equivalent implementations which would provide the same preferred lateral orientation of the tees. A different quantity could be provided, e.g. three. The material of holder 26 could be of other suitable material such as plastic or leather. The golf glove 22 could be of different design and material.

Although shown as a left hand golf glove tee holder 20 for a right handed golfer, the invention could be practiced in a right hand glove for a left-handed golfer. Since gloves are marketed in pairs, the tee holder 20 could be supplied on either or both.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An improved combination golf glove and tee holder comprising:

a golf glove, worn by a golfer, having a longitudinal axis extending through a cuff end thereof and a fingertip end thereof; and a tee holder, attached to a rear region of said golf glove, made and arranged to hold a plurality of tees side-by-side and oriented in a lateral direction substantially perpendicular to the longitudinal axis, said tee holder being disposed on said golf glove in a practical location that is particularly selected to prevent any portion of the tees from ever exerting any pressure through said golf glove onto any portion of the golfer's arm, wrist and hand regions regardless of extreme knuckle and wrist flexure, thus positively preventing any possibility of distraction to the golfer, including discomfort and risk of injury, from the tees.

2. The improved combination golf glove and tee holder as defined in claim 1 wherein said golf glove is configured with a closure flap that is fitted with hook-and-pile type closure fastenings made and arranged to firmly enclose the golf glove around the golfer's wrist region, the closure flap being disposed on a rear region of said golf glove near the cuff end thereof, said tee holder being disposed on the rear region of said golf glove, between the closure cap and a finger region of said golf glove.

3. The improved combination golf glove and tee holder as defined in claim 2 wherein said tee holder is made and arranged to hold two tees.

4. The improved combination golf glove and tee holder as defined in claim 3 further comprising;

a ball marker for putting green purposes, removably attached to said golf glove in a manner to be conveniently available to the golfer as required.

5. The improved combination golf glove and tee holder as defined in claim 4 wherein said ball marker is attached to the closure flap of said golf glove by a snap fastener system.

6. The improved combination golf glove and tee holder as defined in claim 2 herein the snap fastener system comprises:

a dome fastener element permanently affixed to the ball marker; and a socket fastener element, made and arranged to mate with the dome fastener element in a snap manner, permanently affixed to the closure flap of said glove.

* * * * *

UNITED STATES PATENT AND TRADEMARK OFFICE

CERTIFICATE OF CORRECTION

PATENT NO. : 6,205,588 B1
DATED : March 27, 2001
INVENTOR(S) : Ku Hyon Shin

It is certified that error appears in the above-identified patent and that said Letters Patent is hereby corrected as shown below:

Column 4,
Line 53, i.e., second line of claim 6, delete "claim 2" and enter therefor -- claim 5 --.

Signed and Sealed this

Sixteenth Day of April, 2002

*Attest:*

*Attesting Officer*

JAMES E. ROGAN
*Director of the United States Patent and Trademark Office*